United States Patent [19]

Führing

[11] 4,197,609

[45] Apr. 15, 1980

[54] SUCTION APPARATUS FOR EXTRACTING LIQUIDS FROM A WEB

[75] Inventor: Heinrich Führing, Augsburg, Fed. Rep. of Germany

[73] Assignee: Böwe Maschinenfabrik GmbH, Augsburg, Fed. Rep. of Germany

[21] Appl. No.: 877,802

[22] Filed: Feb. 15, 1978

[30] Foreign Application Priority Data

Feb. 16, 1977 [DE] Fed. Rep. of Germany ..... 2705496

[51] Int. Cl.[2] ..... B08B 5/04

[52] U.S. Cl. ..... 15/306 A

[58] Field of Search ..... 15/302, 306 R, 306 A, 15/306 B, 307, 308, 345

[56] References Cited

U.S. PATENT DOCUMENTS

| | | | |
|---|---|---|---|
| 2,142,711 | 1/1969 | Birch | 15/306 A |
| 3,992,746 | 11/1976 | Rhodes | 15/307 |

FOREIGN PATENT DOCUMENTS

| | | | |
|---|---|---|---|
| 178084 | 9/1953 | Austria | 15/306 R |
| 2455194 | 5/1975 | Fed. Rep. of Germany | 15/306 A |
| 568623 | 3/1924 | France | 15/306 A |

*Primary Examiner*—Christopher K. Moore
*Attorney, Agent, or Firm*—Karl F. Ross

[57] ABSTRACT

A suction apparatus for extracting liquids from a web, e.g. an organic solvent from a fabric treated with the solvent by impregnation, comprises a tube having a pair of shell halves defining an axially extending gap between them, the web passing over this gap and the tube being evacuated. The gap is widened or narrowed by a jaw-type mechanism which can be adjusted by a screwthread assembly tending to swing the jaws of the device about a hinge axis lying outside the tube diametrically opposite the slot or gap.

15 Claims, 5 Drawing Figures

SUCTION APPARATUS FOR EXTRACTING LIQUIDS FROM A WEB

FIELD OF THE INVENTION

The present invention relates to a suction apparatus for drawing a liquid from a web and, more particularly to a web-treatment apparatus adapted to withdraw a fluid under suction.

BACKGROUND OF THE INVENTION

In the treatment of webs of material and particularly the treatment of fabrics, it is a common practice to subject the fabric to treatment with a liquid and to then withdraw the liquid from the fabric under suction prior to drying by heating or other processes.

For example, a textile web may be treated with an organic solvent, e.g. as part of a dyeing or other textile-finishing operation, whereupon the major part of the solvent is removed from the web by passing the same over a surface having an opening which is evacuated. The fabric may thereafter be subjected to heating or the like to volatilize any residual solvent.

In a textile-treating apparatus which utilizes suction to recover at least a portion of the liquid used to treat the fabric, it is conventional to pass the web across a longitudinally extending slot of an evacuated tube so that the liquid is drawn into the tube through this slot. It is with such devices that the present invention is concerned.

German open application (Offenlegungsschrift) DT-OS 24 55 194 discloses a system of this type in which the width of the gap or slot is adjustable to control the suction applied to the web.

In this arrangement, the slot or gap is provided between two tube or shell halves which define the slot as a gap between them. The gap width is adjustable by pins extending transverse to the tube axis and movable to draw the shell halves together or urge them apart. The pins are actuated from a remote location by means of a worm gear and spindle.

The pins, however, lie within the duct formed by the tube halves and which is evacuated so that contaminants such as slubbing, filaments, fleece or the like can accumulate upon or around the pin and give rise to blockage of the duct. A pin within the duct also creates problems in the cleaning of the latter and may even interfere with the suction which can be developed at the gap or slot.

OBJECT OF THE INVENTION

It is the principal object of the present invention, therefore, to provide an improved apparatus for the removal of a fluid from a textile web whereby the disadvantages of the earlier system discussed above can be obviated and control all of the gap width can be afforded in a simple and convenient manner.

Another object of the invention is to provide an evacuating tube for the purpose described with adjustable gap width but without interference, with the suction capable of being developed by the tube, on the part of the slot-adjusting mechanism.

It is also an object of the invention to provide an apparatus for the purposes described which has a reducing tendency toward blockage and which affords greater ease of cleaning.

SUMMARY OF THE INVENTION

This object and other which will become apparent hereinafter are attained, in accordance with the present invention, in a device for the evacuation of liquid from a fabric web which has an axially extending slot defined between a pair of tube or shell halves and with an adjustable gap width as controlled by an adjustment mechanism which lies wholly externally of the tube so that the interior of the latter does not contain any element capable of obscuring the development of suction, adapted to collect contaminants such as fabric particles free from any structure within the tube which can interfere with the cleaning thereof.

More specifically, the adjusting means includes at least one pair of hingedly interconnected jaws respectively engaging the tube halves and having a pivot axis lying externally of the tube and preferably outside of the latter immediately adjacent the opposite side of the tube from that provided with the slot.

According to a feature of the invention, mechanism is provided for relatively displacing and retaining the two jaws in appropriate positions, this mechanism preferably including screw thread means.

More specifically, the system of the present invention comprises a first member fixed to one of said tube or shell halves externally of the tube and a second member fixed externally of the tube to the other tube or shell half, the two members being interconnected externally of the tube by an adjusting mechanism which displaces the tube halves relative to one another. A hinge or pivot joint whose axis lies parallel to the tube axis and the slot, interconnects the members and the mechanism can be disposed on the side of the hinge opposite that at which the tube halves are connected to the members.

According to a feature of the invention, each of the members constitutes a double-arm lever, one arm of which is anchored to the respective tube halves while the other arm is connected to the setting mechanism previously described.

When the other arms of the two levers are urged apart, moreover, the first arms are drawn together to reduce the width of the slot.

The device for adjusting the slot width, therefore, preferably comprises a plier-type mechanism in which each of the half shells or tube halves is engaged externally by respective jaws or claws of the members of the device which are hinged together so that, as the arms of the device are drawn together or apart, the gap width is correspondingly varied. Such a construction is relatively simple and reliable and it is possible, with this construction, to fix one of the pipe halves while permitting the other half to move relative thereto.

According to another feature of the invention, each of the jaws has a formation or arm extending away from the pivot or hinge axis, these arms being connected by a screwthread arrangement so that they may be drawn together or spread apart. The screwthread mechanism may have an axis extending perpendicular to but spaced from the hinge axis.

The screwthread arrangement can include a nut axially fixed on one of the arms but rotatable to displace a threaded spindle axially fixed on the other arm or, alternatively, a rotatable but axially fixed spindle may be provided for engagement with a rotationally fixed and axially fixed nut on the other arm. When a spindle or nut is rotatable to operate the device, it can be coupled with a worm wheel or gear, the latter being displaced by a worm which meshes therewith.

In yet another alternative, one or more nuts may be threaded onto a spindle to bear upon a member for the displacement thereof or nuts can be provided on the spindle as locking members.

For remote operation of the device, it is preferred to provide the worm gear coaxial with the threaded bolt and to dispose the worm, which meshes with the worm gear, between the axis of the bolt and the axis of the hinge.

The suction tube can have any conventional cross section. It can be, for example, a conical section or can have a prismatic configuration (i.e. a polygonal perimeter or polyhedral perimeter cross section). Naturally, the term "half shell" or "tube half" as used herein need not require that either of the two members defining the gap extend over a full 180° of arc or subtend the full 180° engle. Each of the two members can extend over or subtend less than 180° as long as the Figure formed by the two members, in cross section, is a closed Figure except for the gap. When the gap is closed, naturally, the two members, together with any intervening structure, should extend over a full 360°. However, it is preferred to connect the two members at the side thereof opposite the slot by a flexible or resilient sealing element to allow the resilient displacement of the two members by the respective jaws in the manner described.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
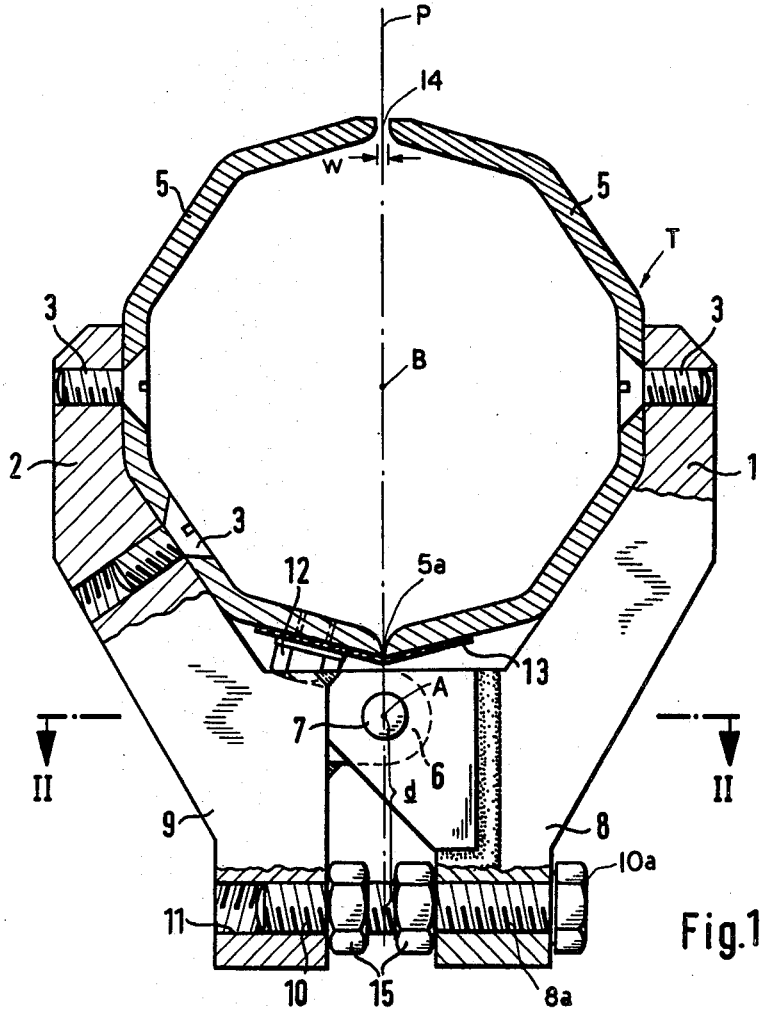
FIG. 1 is a diagrammatic cross sectional view taken in a plane perpendicular to the axis of the suction tube, of a suction apparatus in accordance with the present invention.
Figure 2:
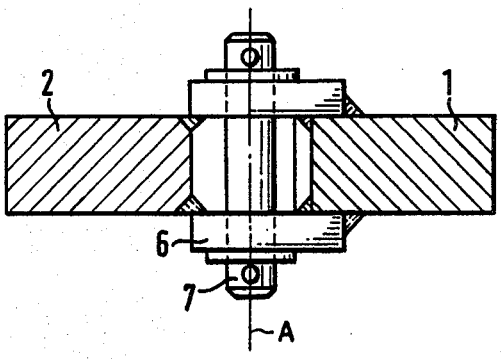
FIG. 2 is a cross sectional view taken along the line II—II of the FIG. 1.
Figure 5:
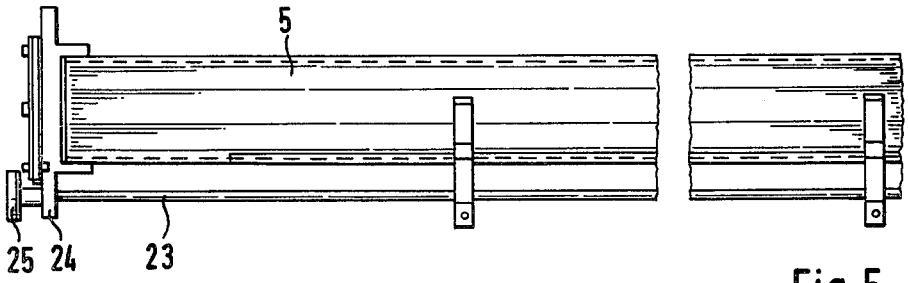
FIG. 5 is a partial side elevation of the suction tube.

The apparatus shown in FIGS. 1 and 2 comprises a pair of jaws 1 and 2 which are connected respectively by countersunk screws 3 to the outer faces of 5-sided tube halves or half shells 5. The two tube halves 5 thus together form a 10-sided prismatic or polygonal-section suction duct which can be closed at its ends (see FIG. 5) and evacuated by conventional means (see German open application—Offenlegungsschrift—DT-OS 24 55 194).

The two jaws 1 and 2 are interconnected by hinge joint 6 which is traversed by a pintle 7 to define a pivot axis A which lies parallel to a generatrix of the tube generally represented at T and hence parallel to the axis B thereof. The axis A lies immediately adjacent to the outer wall of the tube T diametrically opposite the slot 14 formed between the two halves and in a plane P through the axis B and the slot 14.

At their lower edges, 5*a*, the shell halves 5 may be practically in contact with one another and can be spanned by a yieldable (flexible) resilient strip 13 forming a seal directly opposite the slot 14, the sealing strip 13 being held in place by screws 12. The width W of the slot 14, which extends longitudinally of the tube T is adjustable as will be apparent hereinafter.

Each of the jaws 1 and 2 is formed with an abutment or arm 8,9 projecting below the axis A and extending perpendicular to this axis. A threaded bolt 10 extends perpendicular to the axis A and is received with clearance in a bore 8*a* of the arm 8 while being screwed into the internally threaded bore 11 of the arm 9. Thus, by rotation of the bolt 10, via its head 10*a* and a suitable wrench, the width W of the slot 14 can be adjusted. Since the distance d between the bolt 10 and the axis A is substantially less than the distance between the slot 14 and the axis A, only a slide rotation of the bolt 10 is effective to adjust the gap width by a significant amount. As a consequence, for most useful gap widths, the arms 8 and 9 remain practically parallel to one another and then tilt relatively so as to exceed the available play in the bore 8*a*.

Nut 15, threaded onto the bolt 10, between the arms 8 and 9 serve as locking nuts to retain the preset gap width. It is also possible, in the context of the present invention, to substitute for the nuts 15, a cylindrical spring which bears in opposite directions upon the arms 8 and 9 and surrounds the bolt 10.

Figure 3:
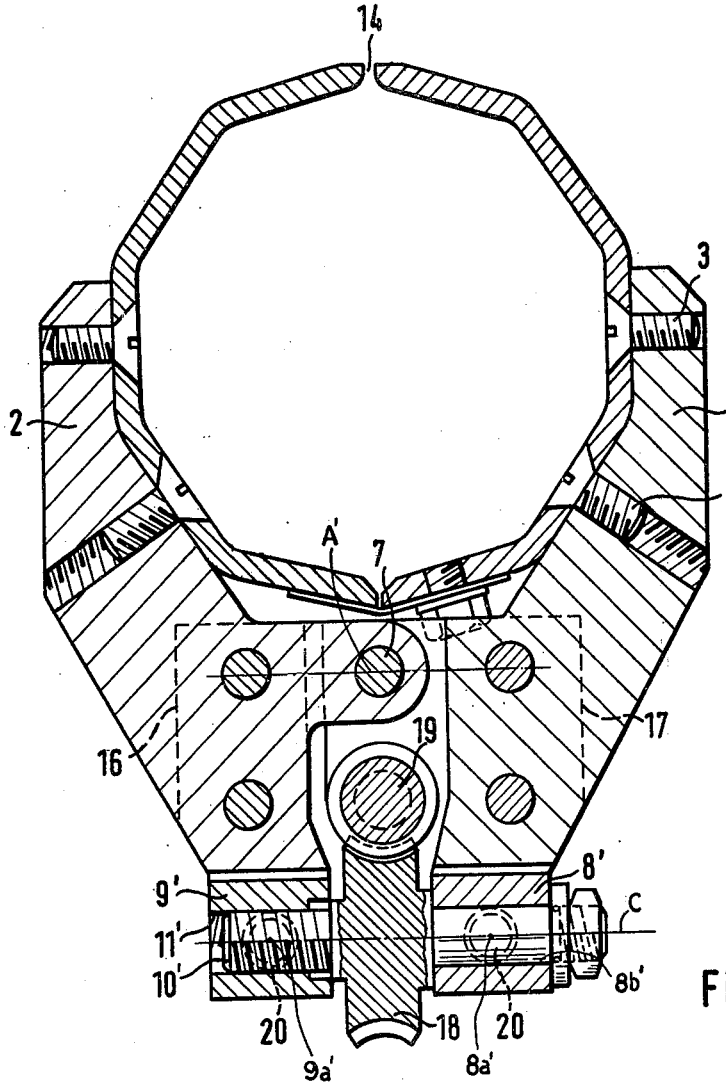
FIG. 3 is a view similar to FIG. 2 illustrating another embodiment of the present invention, the section of FIG. 3 corresponding to a cross section along the line III—III of FIG. 4.
Figure 4:
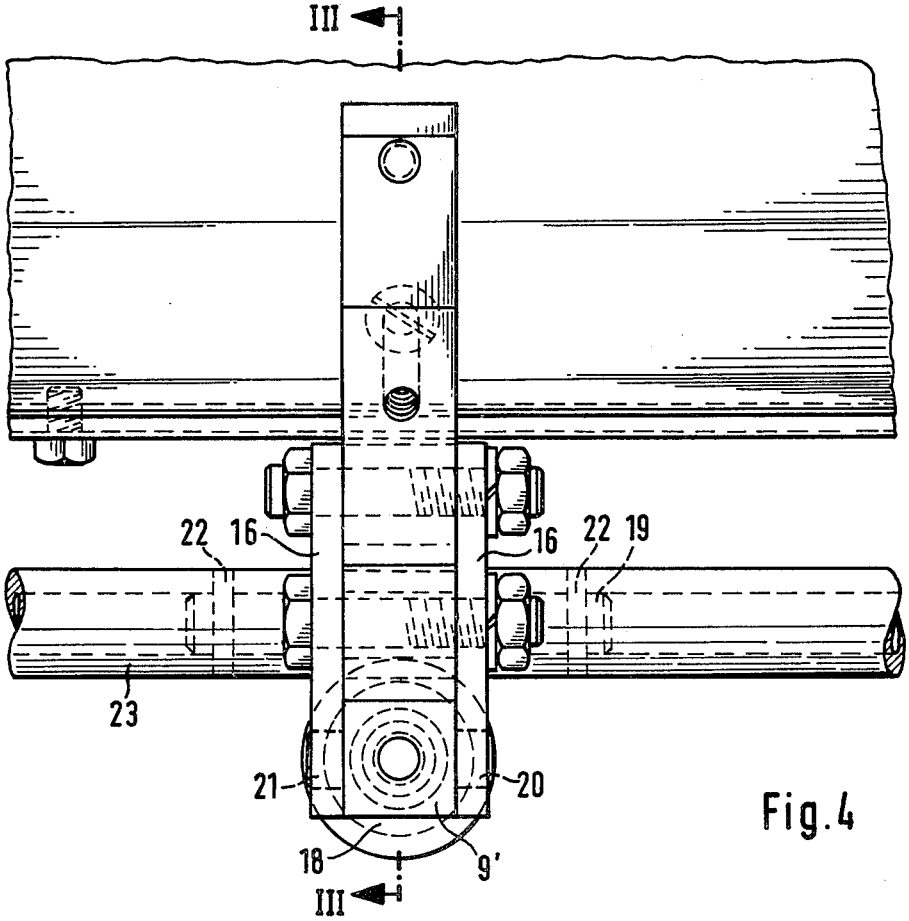
FIG. 4 is a side elevational view of the apparatus of FIG. 3.

FIG. 3 and 4 illustrating embodiment of the invention which is particularly useful when larger gap widths are desirable and when the range of variation of the gap width is to be greater than is available with the play afforded between the bolt 10 and the arm 8.

In this case, the arms 8' and 9' are pivotally received in pivots 20 and 21 projecting into links 16 and 17 respectively bolted to the jaws 1 and 2 so that these arms 8' and 9' can pivot about axes 8*a'* and 9*a'* lying perpendicular to the axis C of the bolt 10'. The bolt 10' here threadedly engages bolt 11' of the arm 8'.

The bolt 10', affixed to a worm gear 18 meshing with a worm 19 disposed between the bolt 10' and the hing joint A', along the tube formed between the seal halves 5, a plurality of such gap-halve adjusting devices are provided, all of the worms 19 of which are connected by pins 22 to a tube 23 which is rotatably received in the end plates 24 which close the opposite axial end of the suction tube and through which evacuation may be effected. A handwheel 25 is connected with the tube 23 to permit final adjustment of all of the devices.

I claim:

1. A suction apparatus for extracting a liquid from a web, said apparatus comprising:

a pair of elongated shell halves concave toward one another and forming between them an evacuatable duct communicating with a slot defined between confronting longitudinal edges of said shell halves;

means connecting said shell halves together whereby displacement of one of said shell halves toward the other shell half reduces the width of said slot while displacement of said one of said shell halves away from said other shell half widens said slot;

respective members disposed externally of said duct and connected externally to each of said shell halves;

setting means between said members externally of said duct for displacing said members to establish the width of said slot; and means for sealing at least one end of said duct to permit the generation of suction therein, each of said members being elongated and forming a lever, said members being pivotally connected together and having respective first arms on one side of their mutual pivot secured externally to the respective shell half and respective second arms extending to another side of said pivot and bridged by said setting means.

2. The apparatus defined in claim 1 wherein said setting means includes at least one bolt disposed between said second arms and extending substantially perpendicular to the axis of said pivot, the axis of said pivot lying substantially parallel to the axis of said duct and to said slot.

3. The apparatus defined in claim 2 wherein said bolt is threaded into one of said second arms and passes with clearance through the other of said second arms.

4. The apparatus defined in claim 2 wherein said bolt is provided with a threaded element carrying a worm gear, said setting means comprising a worm having an axis substantially parallel to the pivot axis.

5. The apparatus defined in claim 4 wherein said worm gear is mounted upon and is coaxial with said bolt.

6. The apparatus defined in claim 2 wherein each of said second arms is provided with an element pivotal thereon about a pivot axis parallel to the axis of the pivot between said levers, said setting means being disposed between said elements.

7. The apparatus defined in claim 6 wherein said bolt is threaded into one of said elements and is rotatable in the other of said elements, said setting means including a worm gear mounted on said bolt between said second arm and a worm meshing with said worm gear and disposed between said second arms.

8. The apparatus defined in claim 2, further comprising a sealing strip bridging said shell halves opposite said slot.

9. The apparatus defined in claim 2 wherein each of said shell halves has a polyhedral perimeter.

* * * * *